US005421571A

United States Patent [19]

Tauber

[11] Patent Number: 5,421,571

[45] Date of Patent: Jun. 6, 1995

[54] APPARATUS FOR THE SEPARATE SUPPLY OF FILM BAGS TO A FILING MACHINE

[75] Inventor: Udo Tauber, Verden/Aller, Germany

[73] Assignee: Hensen GmbH, Kirchlinteln, Germany

[21] Appl. No.: 150,097

[22] PCT Filed: May 2, 1992

[86] PCT No.: PCT/DE92/00368

§ 371 Date: Jan. 21, 1994

§ 102(e) Date: Jan. 21, 1994

[87] PCT Pub. No.: WO92/21219

PCT Pub. Date: Nov. 26, 1992

[30] Foreign Application Priority Data

May 23, 1991 [DE] Germany ..... 41 16 784.8

[51] Int. Cl.[6] ..... B65H 1/22

[52] U.S. Cl. ..... 271/151; 271/31; 271/107; 271/104; 271/154

[58] Field of Search ..... 271/10, 107, 30.1, 31, 271/31.1, 104, 105, 149–155, 130, 111

[56] References Cited

U.S. PATENT DOCUMENTS

| | | | |
|---|---|---|---|
| 3,722,678 | 3/1973 | Kistner | 271/31 |
| 3,773,319 | 11/1973 | Hottendorf et al. | 271/151 |
| 4,369,959 | 1/1983 | Hornbuckle | 271/151 |
| 4,730,823 | 3/1988 | Barela et al. | 271/155 |
| 5,356,129 | 10/1994 | Godlewski | 271/152 |

FOREIGN PATENT DOCUMENTS

| | | |
|---|---|---|
| 3044557 | 6/1982 | Germany . |
| 3835915 | 6/1989 | Germany . |
| 428255 | 5/1935 | United Kingdom . |
| 444306 | 3/1936 | United Kingdom . |
| 1248511 | 10/1971 | United Kingdom . |

*Primary Examiner*—H. Grant Skaggs
*Attorney, Agent, or Firm*—James E. Larson; Herbert W. Larson

[57] ABSTRACT

Apparatus for the separate supply of film bags to a filling machine, with a belt conveyor receiving the film bags as an oblique, fanned out stack. A drive acts on the belt conveyor. A separating wheel is positioned adjacent to the delivery section of the belt conveyor and rests on the top film bag brought in by the belt conveyor. A lever vertically supports the separating wheel and a drive moves the separating wheel. A sensor determines the height of the separating wheel above the belt conveyor. Such sensor controls the drive for the belt conveyor (12). A linear unit supplies a bag to the filling machine.

8 Claims, 1 Drawing Sheet

APPARATUS FOR THE SEPARATE SUPPLY OF FILM BAGS TO A FILING MACHINE

BACKGROUND OF THE INVENTION

The invention relates to an apparatus for the individualized, separate or single supply of film bags to a filling machine.

DE-OS 2,922,877 discloses an apparatus for the separate supply of valve bags to a filling machine and in which the valve bags to be supplied rest in a fanned out manner on a belt conveyor and are separated or individualized by a clamping wheel.

British Patent 492,920 discloses an apparatus for the supply of sheets, in which blanks are conveyed on a belt conveyor and separated by a driven wheel.

The problem of the invention is to provide an improved apparatus for the separate supply of film bags to a filling machine.

SUMMARY OF THE INVENTION

According to the invention this problem is solved by the features of the apparatus. My apparatus for supplying film bags to a filling machine employs a belt conveyor to transport the bags with a drive element acting on the belt conveyor. A vertically movably mounted separating wheel rests on the top of a film bag supplied by the conveyor. A linear device with a suction cup at one end supplies the first film bag on the belt conveyor to the filling machine. A drive element moves the separating wheel. A photoelectric sensor determines the height of the separating wheel while controlling the belt conveyor drive. A second photoelectric sensor controls the separating wheel drive.

BRIEF DESCRIPTION OF THE DRAWING

The invention is described in greater detail hereinafter relative to the single diagrammatic drawing illustrating an embodiment of the invention as an elevational view partially in section.

DETAILED DESCRIPTION OF THE INVENTION

Figure 1:
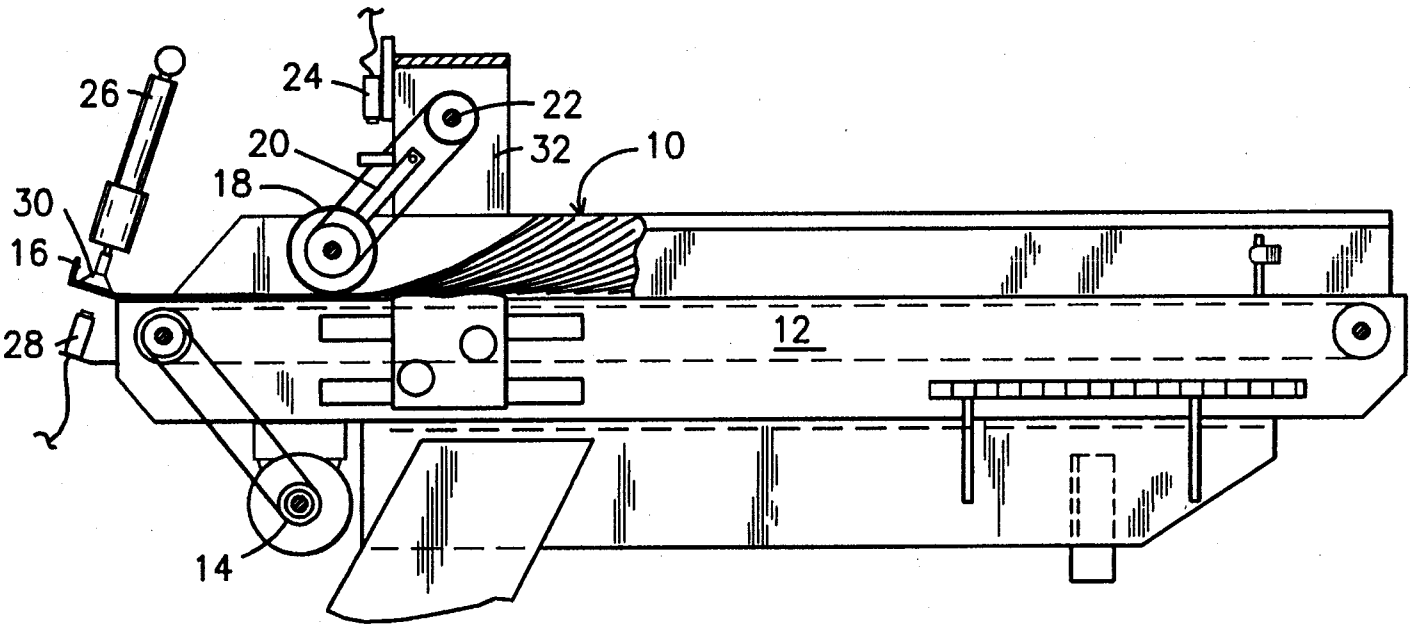

The apparatus comprises a belt conveyor 12 onto which the film bags 10 to be supplied separately to the not shown filling machine are placed in the form of an oblique, fanned out stack. The belt conveyor 12 is provided with a drive 14, which moves the upper strand of the belt conveyor 12 towards a stop 16 of a delivery section.

A separating wheel 18 is movably mounted on a pivoted lever 20 and is driven clockwise by a drive 22 via a driving chain, the pivoted lever 20 and the drive 22 being mounted on a bridge 32 displaceable in the conveying direction. As the separating wheel 18 rests on the in each case top fill bag 10, it moves the said top bag 10 towards the stop 16 of the delivery section.

A first sensor 24 determines the position of the pivoted lever 20 and therefore the height of the separating wheel 18 above the belt conveyor 12. The sensor 24 controls the drive 14 of the belt conveyor 12 in such a way that the number of film bags 10 below the separating wheel 18 remains substantially the same. If the number of film bags 10 below the separating wheel 18 is too low, the belt conveyor 12 is driven and supplies further bags, whereas if the number of film bags 10 below the separating wheel 18 is adequate, then the belt conveyor 12 is stopped.

The sensor 24 can be a photoelectric cell. However, it is also possible to provide a potentiometer, which is located in the pivot point of the pivoted lever 20. There can also be a continuous control in the case of such an apparatus.

A second sensor 28 also constructed as a photoelectric cell is positioned in the vicinity of the stop 16 of the delivery section and detects when the separating wheel 18 has supplied a film bag up to the stop 16 of the delivery section. This second sensor 28 acts on the separating wheel 18 and therefore ensures that the bag has been inserted up to the stop 16.

A linear unit 26 provided with a suction cup takes the separated film bag 10 from the delivery section and supplies it to the filling machine, where it is gripped with not shown devices and supplied to the filling station.

I claim:

1. In an apparatus for separately supplying film bags to a filling machine having a belt conveyor receiving the film bags as an oblique fanned out stack, and drive means acting on the belt conveyor, a vertically movable mounted separating wheel positioned adjacent to a delivery section of the belt conveyor, the belt conveyor provided with a stop, the separating wheel resting on a top film bag supplied by the belt conveyor and a device for supplying the top film bag on the belt conveyor to the filling machine, the improvement wherein a drive means is provided for turning the separating wheel, a first sensor is mounted on the apparatus for determining a height of the separating wheel and controlling the drive means acting on the belt conveyor, and a second sensor mounted at the stop, controlling the drive means for turning the separating wheel.

2. The apparatus according to claim 1 wherein the separating wheel is mounted on a pivoted lever, the first sensor determining the position of the pivoted lever.

3. The apparatus according to claim 2 wherein the first sensor is a photoelectric cell.

4. The apparatus according to claim 2 wherein the second sensor is a photoelectric cell.

5. The apparatus according to claim 1 wherein the first sensor is a photoelectric cell.

6. The apparatus according to claim 1 wherein the second sensor is a photoelectric cell.

7. The apparatus according to claim 1 wherein the first and second sensors are photoelectric cells.

8. The apparatus according to claim 1 wherein the device for supplying the top film bag on the belt conveyor to the filling machine is a linear unit with a suction cup proximal to the belt conveyor.

* * * * *